US005081640A

United States Patent [19]

Bebber et al.

[11] Patent Number: 5,081,640

[45] Date of Patent: Jan. 14, 1992

[54] METHOD OF CONTROLLING A TEMPERATURE OF A MOLTEN METAL

[75] Inventors: Hans J. Bebber, Mülheim; Karsten Brabandt, Essen; Bernhard Espendiller, Dülmen, all of Fed. Rep. of Germany

[73] Assignee: Mannesmann Aktiengesellschaft, Dusseldorf, Fed. Rep. of Germany

[21] Appl. No.: 522,176

[22] Filed: May 11, 1990

[30] Foreign Application Priority Data

May 12, 1989 [DE] Fed. Rep. of Germany ..... 3915619

[51] Int. Cl.[5] ..... H05B 7/00; H05H 1/00

[52] U.S. Cl. ..... 373/25; 373/40; 373/49; 373/77; 373/102; 373/105; 373/106; 219/497

[58] Field of Search ..... 373/22, 18, 25, 24, 373/40, 49, 70, 77, 39, 102, 104, 105, 106; 219/491, 494, 497; 72/184; 75/65, 382

[56] References Cited

U.S. PATENT DOCUMENTS

| | | | |
|---|---|---|---|
| 3,333,452 | 8/1967 | Sendzimir | 72/184 |
| 4,323,763 | 4/1982 | Goldsmith | 373/77 |
| 4,484,947 | 11/1984 | Marshall | 75/382 |
| 4,486,211 | 12/1984 | Monaghan | 373/40 |

FOREIGN PATENT DOCUMENTS

| | | | |
|---|---|---|---|
| 3810292 | 10/1989 | Fed. Rep. of Germany | 373/106 |
| 0762216 | 9/1980 | U.S.S.R. | 373/105 |
| 1453631 | 1/1989 | U.S.S.R. | 373/106 |

*Primary Examiner*—Bruce A. Reynolds
*Assistant Examiner*—Tu Hoang
*Attorney, Agent, or Firm*—Cohen, Pontani & Lieberman

[57] ABSTRACT

A method of controlling the course over time of a target temperature of a molten metal in a ladle, for example, in which the required heating power is produced by at least one plasma torch. Determination is made of the variation with time of a target temperature, the mass of an outwardly flowing melt, and a specific heat value of the melt present in the ladle. From the foregoing values there is ascertained the course of a corresponding setting signal for obtaining the heating power necessary to obtain the desired temperature course. Simultaneously and continuously the actual temperature of the melt is measured. When the actual temperature of the melt deviates from its target temperature in excess of a predetermined tolerance, the setting signal for the heating power is changed by decreasing such setting when an actual temperature exceeds the target temperature, and increasing such setting when an actual temperature is less than the target temperature.

6 Claims, 4 Drawing Sheets

METHOD OF CONTROLLING A TEMPERATURE OF A MOLTEN METAL

BACKGROUND AND SUMMARY OF THE INVENTION

The present invention relates to a method of controlling a temperature of a molten metal in a ladle or at the outlet of a distributor trough, wherein the thermal energy necessary for this purpose is produced by at least one plasma burner also referred to as a plasma torch.

From European Patent A1-0 180 741 a method and an apparatus for maintaining or increasing the temperature of a molten metal present in a receiving vessel by the feeding of energy are known, wherein the energy necessary for this purpose is introduced by one or more plasma burners. That patent, however, lacks any information as to how the heating power necessary for a predeterminable temperature is to be measured. Furthermore, no limit conditions as to when the temperature to be obtained are mentioned.

In addition, methods are also known in which the energy necessary for the heating is introduced into molten metal by an induction heater that is firmly connected to a distributor trough of a continuous casting installation (see, for instance, European Patent A1-0 132 280). Such methods, however, have the disadvantage, among others, that a separate heating device must be provided for each vessel, which is very expensive and disadvantageous, particularly in the case of teeming ladles.

An object of the invention is to provide a method that gives assurance that the temperature of a molten metal in a ladle or a casting trough at a predeterminable point, for instance at the outlet of the vessel, corresponds to a predeterminable variation with time of the temperature, even if disturbing influences occur, in which connection in the simplest case, the course of the temperature may also be constant (i.e. maintaining the temperature).

The foregoing object is achieved in the case of a ladle in the manner that:

the variation with time of a target temperature, the mass or the mass flow of the outward flowing melt and the specific values of the melt present in the ladle, as well as system parameters, are introduced into an adaptive regulation;

from the foregoing values there is determined a setting signal suitable for the heating power necessary for obtaining the desired course of the temperature;

at the same time, the actual temperature of the melt is continuously measured; and the setting signal for the heating power, in the event of a deviation of the actual temperature of the melt from its target temperature which exceeds a predeterminable tolerance, is changed by means of a control in the manner such that, in the event that the actual temperature exceeds the target temperature, it is decreased; and in the event that the actual temperature is less than the target temperature, it is increased.

The heating power determined by the regulation, which can in principle also have a course that is a function of the time, can for instance, as shown by experience, produce the desired course of the target temperature in the event that there are no disturbances. However, the feeding back of the measured temperature to a controller serves for adapting the heating power determined on the basis of the values introduced, to the heating power actually necessary for obtaining the target temperature in the event that disturbing influences occur, so that the course of the temperature of the molten metal, for instance at the outlet of the ladle, is adjusted to the target course, except for a predeterminable tolerance.

In connection with a distributor trough in which the melt does not stay but flows through, it is contemplated, in accordance with an aspect of the invention, to introduce into the regulation, in addition to the values to be introduced in the case of a ladle, also (i) the temperature of the melt upon entrance into the distributor trough, (ii) the mass of the melt to be introduced as a whole into the distributor trough and (iii) the mass flow thereof upon the entrance into and the emergence from the distributor trough. In this case, if the actual temperature of the melt is measured at the outlet of the distributor trough and not below the power connection by the plasma burner, the setting signal for the heating power must be changed, with due consideration of the system-determined dead time.

However, it is also possible, in accordance with a further aspect of the invention, to operate the control of the setting signal for the heating power which is necessary in each case without regard to a system-determined dead time if, in addition to the temperature at the outlet of the distributor trough, the temperature in the melt below the plasma burner, and therefore in the region of the introduction of the heat, is also measured. In this case it is even possible to adjust the course of the temperature of the melt at the outlet of the distributor trough with respect to the target course within a predeterminable tolerance even without use of a regulation.

In order to operate the system with favorable efficiency, it is furthermore provided (i) to set the distance corresponding to the arc length between the plasma burner and the melt at a small initial value and to vary the current intensity in accordance with the required heating power, (ii) to compare the heating power required in each case with a heating-power characteristic value that is possible with maximum current intensity and the initial spacing between the plasma burner and the melt, and (iii) to effect the adaptation of the power necessary for the temperature control, as long as the required heating power is below the heating power characteristic value, exclusively via the current intensity (with the arc length equal to the initial spacing), and if the required heating power lies above the heating-power characteristic value, then exclusively via the distance between the plasma burner and the melt (with the arc current equal to the maximum current intensity).

BRIEF DESCRIPTION OF THE PREFERRED EMBODIMENTS

Embodiments of the invention are shown in the drawing and will be explained in further detail below. In the drawings.

DETAILED DESCRIPTION OF THE PREFERRED EMBODIMENTS

Figure 1:
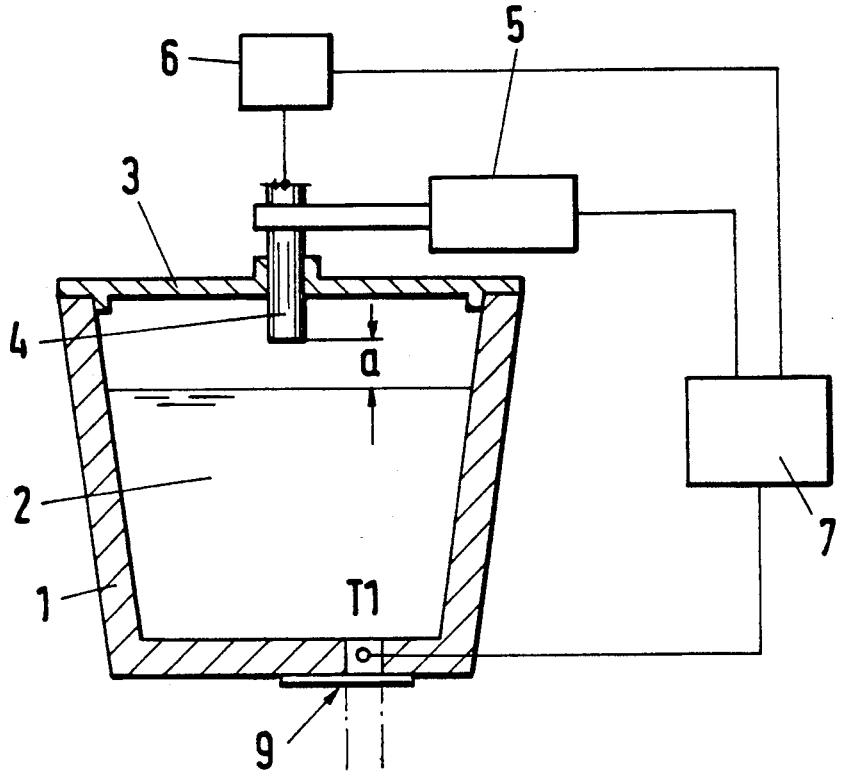
FIG. 1 shows a teeming ladle with the corresponding means for controlled heating of the melt, partially in block diagram form.

The steel-mill or teeming ladle 1 shown in FIG. 1 is filled with a molten metal 2. A plasma burner 4 is introduced through the cover 3 of the teeming ladle 1. The distance a between the burner 4 and the surface of the melt 2, which distance corresponds to the arc length, may be varied by a drive means 5.

Instead of one plasma burner, several, for instance two or three plasma burners, can also be used, depending on the heating power required; such burner(s) being fed with direct or alternating current (or three-phase current) from a source of current 6.

At the outlet 9 of the teeming ladle 1 a temperature measurement point T1 is provided. Between the temperature measurement point T1 and the drive means 5 and the source of current 6, a control and regulating device 7 is provided. At an input side, such device 7 receives a measurement signal of the temperature at the measurement point T1, and is connected with one output each to the drive means 5 and the source of current 6.

Figure 2:
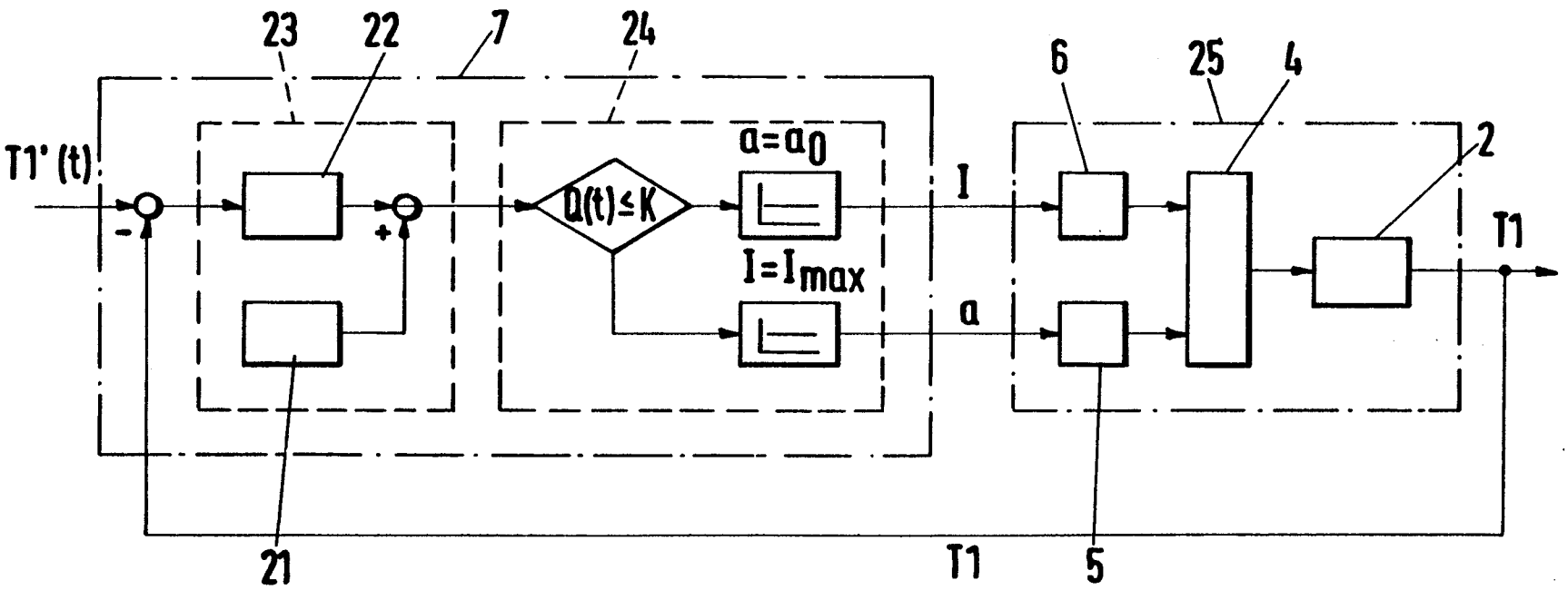
FIG. 2 shows the means for controlled heating of the melt present in the teeming ladle, in block diagram form.

The control and regulating device 7, as shown in FIG. 2, consists of an adaptive regulation device 21 and a control 22, which are connected together to form a unit 23 that in turn, is connected to a power adaptation drive 24. The adaptive regulation device 21 adapts its adjustment program automatically in accordance with the requirements caused by different initial conditions. The power adaptation device 24 influences the source of electrical current 6 and the drive means 5 within a control path 25 containing the plasma burner 4 and the molten metal 2. Feedback is present from the measurement point T1 to the controller 22.

In order to achieve a variation with time of a target temperature T1'(t) of the melt 2 which is to be observed, for instance upon the pouring, on the teeming ladle 1, first of all, there are introduced into the adaptive adjustment 21 and the control 22:

the desired course with time of the target temperature T1'(t); and as initial and limiting conditions, in particular:

the initial temperature T1 of the melt 2;

the mass m2 of the melt 2;

the specific heat capacitance of the melt 2;

the mass flow m9 of the outward flowing melt; and system parameters such as the thickness of the lining of the ladle 1, etc.

From these values the control 21 determines the setting signals for the heating power Q(t) necessary for obtaining the course of temperature desired T1'(t) without regard to any disturbing influences that may occur. In this case, as a basis for making the adjustment, on the one hand the control path 25 is modeled in its different process states and, on the other hand, a reference temperature course of the melt in the state of the operating point is fixed.

The actual temperature T1 of the melt 2 at the outlet of the ladle 1 is measured simultaneously with the introduction of said data and continuously, the control 22, in the event of a difference between the actual temperature T1 and the target temperature T1'(t) which differs from zero or from a predetermined tolerance, changes the setting signal predetermined by the adjustment 21 for the heating power Q(t) in such a manner that the difference which has occurred (T1−T1'(t)) returns to a range within the predeterminable tolerance.

In the power adaptation device 24, in order to obtain optimal efficiency, inquiry is made whether the heating power at the time Q(t) is less than or equal to the heating power K which can be obtained with maximum current intensity $I_{max}$ and an initially established minimum distance $a_o$ of the plasma burner 4 from the surface of the melt 2.

If the heating power Q(t), predetermined by the adjustment 21, is in each case smaller than or equal to the heating power K (also known as the "heating characteristic value"), the current intensity I is correspondingly increased, and if the predetermined heating power Q(t) is greater than the heating power K, the maximum current intensity $I_{max}$ is left unchanged and the distance a of the plasma burner 4 from the surface of the melt 2 is increased corresponding to the predetermined heating power Q(t) with increase of the arc voltage.

Figure 3:
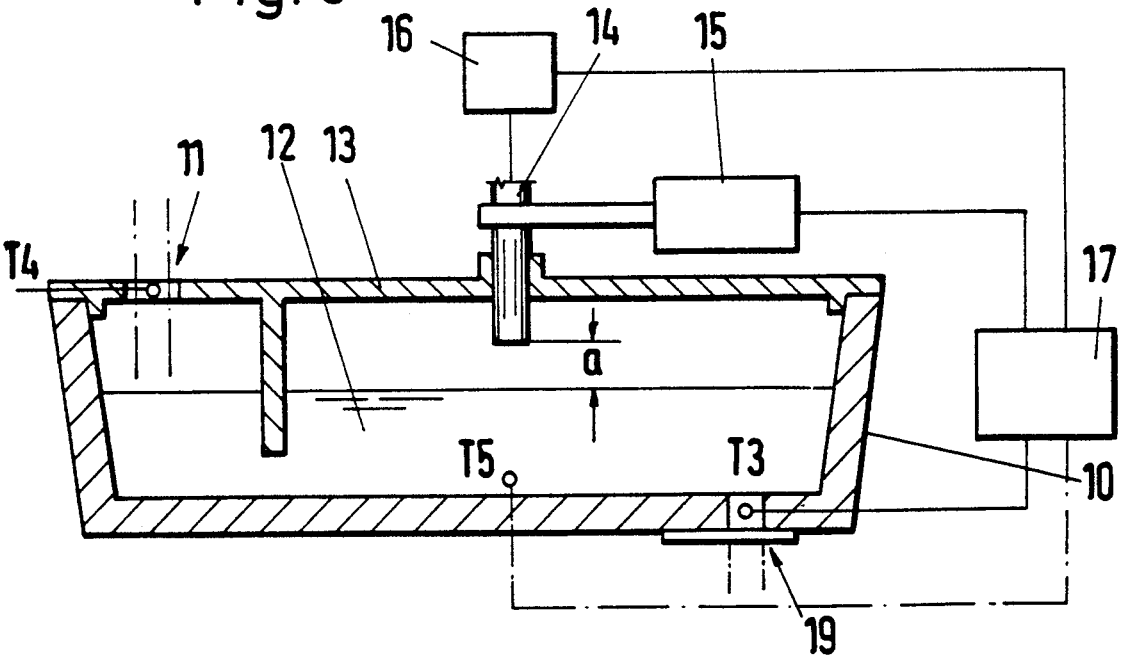
FIG. 3 shows the distributor trough for a continuous casting plant with the corresponding means for controlled heating of the melt, partially in block diagram form.

The pouring or distributing trough 10 shown in FIG. 3 has, at one end, an inlet 11 and at the other end one or more outlets 19 to one or to each of a plurality of continuous casting installations (not shown), such as described, for instance, in U.S. Pat. No. 3,333,452. Through the cover 13 of the distributor trough 10 there are introduced one or more plasma burners 14, the distance a, corresponding to the arc length, from the burner 14 to the surface of the melt 12 being variable through a drive means 15. The plasma burner or burners 14 are connected to a source of electrical current 16. At the one or more outlets of the distributor trough 10 there is provided a respective temperature measurement point T3. Between the measurement point T3 and the drive means 15 and the source of current 16 there is again provided an adjustment and control means 17. On an input side, such means 17 receives a respective measurement signal of the temperature of the measurement point T3 and is connected, in each case via a separate output, to the drive means 15 and the current source 16, respectively.

Figure 4:
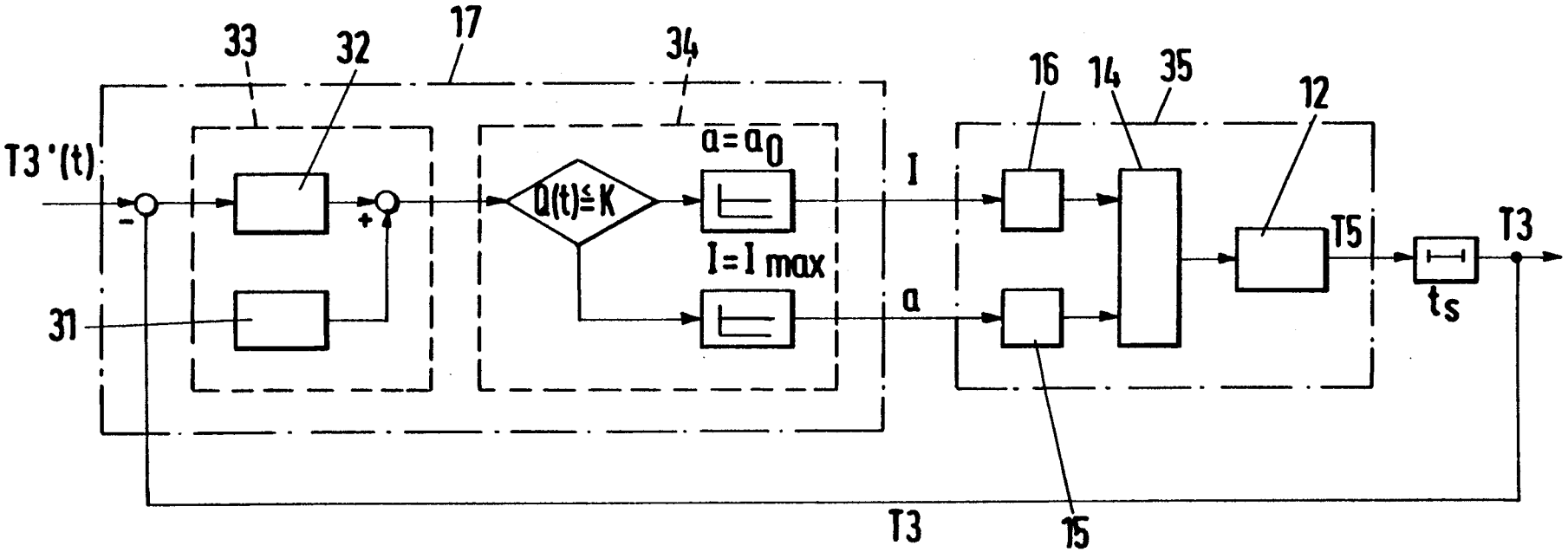
FIG. 4 shows the means for controlled heating of the molten metal in the distributor trough, in block diagram form.

The adjustment and control means 17 for the distributor trough 10, as shown in FIG. 4, consists of an adaptive adjustment device 31 and a control 32 which are connected together to form a unit 33 and of a power adaptation device 34. The adaptive control 31 adapts its control program, again automatically in accordance with the requirements caused by different initial conditions. The power adaptation device 34 influences the source of electrical current 16 and the drive means 15 within a control path 35 containing the plasma burner 14 and the molten metal 12. The heating power, which is in this way connected directly, influences the temperature T5 of the melt 12 (FIG. 3) under the at least one plasma burner 14. This temperature T5 is, however, separated by a dead-time member $t_5$ from the temperature T3, which is relevant for the process and thus for the control and which is, fed back, is compared with the target temperature course T3'(t) by a subtraction the result of which is entered into the controller 32. The dead time $t_5$ is substantially caused by the flowing of the melt 12 in the trough 10 and by a distance in the direction of flow between the heat coupling by one or more plasma burners 14 and the measurement point T3.

In order to obtain the course with time of a target temperature T3'(t) of the melt 12, at the start of the casting process or at the start of a process change there are introduced into the adaptive regulation 31 and the control 32:

the variation with time of the target temperature T3'(t); and as initial and limiting conditions, in particular:

the temperature T4 of the melt at the inlet 11 into the distributor trough 10;

the total mass m2 of the melt to be introduced into the distributor trough 10;

the mass flow (the pouring rate) m11 of the melt at the inlet 11 into the distributor trough 10;

the mass flow m19 at the outlet 19 of the distributor trough 10;

the specific heat capacitance of the melt 12; and system parameters, such as the thickness of the lining of the distributor trough 10, etc.

From these values the regulation device 31 determines the setting signals for the heating power Q(t) necessary in order to obtain the desired course of temperature T3'(t), without consideration of any disturbing influences which may occur.

The regulation device 31, however, responds automatically also to changes in the course of the process (for instance prolonging of a change in ladles, delay upon the pouring, etc.), insofar as they are introduced by additional signals from operating personnel. As a basis for developing the regulation, the control path 35 is in this connection again, on the one hand, modeled in its different process states and, on the other hand, it establishes a reference temperature course of the melt 12 in the distributor trough 10 in the operating-point state.

At the same time as the introduction of said data and continuously, the actual temperature T3 of the melt 12 at the outlet 19 of the distributor trough 10 is measured. The control 32, in the event of a difference of a magnitude greater than zero or a predetermined tolerance between the actual temperature T3 and the target temperature T3'(t), so changes the setting signal predetermined by the regulation 31 for the heating power Q(t) with due consideration of the dead time $t_s$, so that the difference (T3−T3'(t)) which has occurred is returned to a range within the predeterminable tolerance.

In the power adaptation device 34, inquiry is made as to whether the heating power Q(t) at the time is less than or equal to the heating power K (also referred to as heating power characteristic value) which can be obtained with maximum current intensity $I_{max}$ and a minimum distance $a_O$, predetermined at the start, between the plasma burner 14 and the surface of the melt 12.

If the heating power Q(t) predetermined by the control 31 is in each case less than or equal to the heating power K, the current intensity I is correspondingly increased and if the predetermined heating power Q(t) is greater than the heating power K, the maximum current intensity $I_{max}$ is left unchanged and the distance a of the plasma burner 14 from the surface of the melt 12 is increased corresponding to the predetermined heating power Q(t), with increase of the arc voltage.

Figure 5:
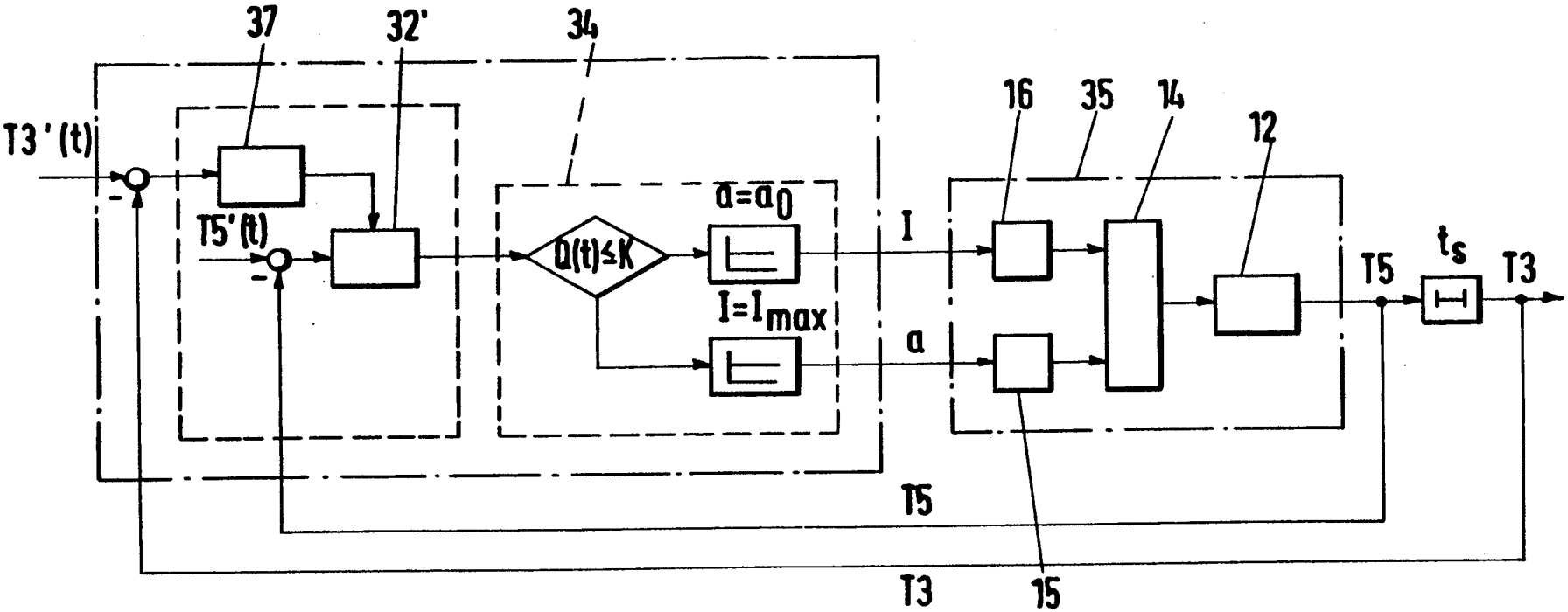
FIG. 5 shows a modified embodiment of the means for the controlled heating of the melt in a distributor trough, in block diagram form.

In order to circumvent the control problem of the system-produced dead time $t_s$ and thus to be able to dispense with an adaptive regulation, a double temperature feedback is provided in the further embodiment of FIG. 5. In this case, in addition to the temperature measurement point T3 at the outlet 1 of the trough 10, use is made of another temperature measurement point T5 which is arranged in the distributor trough 10 below the plasma burner 14 (see dash-dot connecting line in FIG. 3). The measurement signal of the temperature measurement point T5 is introduced, after a subtractive temperature comparison, into the controller 32'. By this measure of establishing a T5-fedback control circuit without dead time compensation it is to maintain the temperature of the melt 12 at the measurement point T5, continuously and independently of disturbances, at a predetermined value or to adapt it corresponding to a predeterminable course.

Consequently, the temperature of the melt 12 at the measurement point T3 now also has essentially the same desired characteristic as the melt at the measurement point T5 since they are separated from each other only by the dead-time member $T_s$. In order now also to adapt the temperature of the melt 12 at the measurement point T3 absolutely to the desired value of the predetermined temperature course T3'(t), the difference between the target temperature T3'(t) and the temperature at the measurement point T3 is introduced with due consideration of the dead time $t_s$, into a controller entrance control 37. Such control 37, in accordance with the temperature difference (T3'−T3) still present, influences the control process of the controller 32' and thus adapts T3 to the target course T3'(t).

It should be understood that the preferred embodiments and examples described are for illustrative purposes only and are not to be construed as limiting the scope of the present invention which is properly delineated only in the appended claims.

We claim:

1. A method of controlling the course over time of a target temperature of a molten metal in a ladle, in which a required heating energy is produced by at least one plasma torch, comprising the steps of:

determining a variation with time of a target temperature, a mass of an outwardly flowing melt and a specific heat value of the melt present in the ladle;

ascertaining from the foregoing values a course of a corresponding setting signal for obtaining the heating energy in order to obtain a predetermined course of temperature;

measuring an actual temperature of the melt in a simultaneous and continuous manner; and measuring a difference between the actual temperature of the melt and the target temperature of the melt and comparing this difference to a pre-determinable tolerance, and changing the setting signal for the heating energy by decreasing said setting signal when an actual temperature exceeds the target temperature and increasing said setting signal when an actual temperature is less than the target temperature.

2. A method according to claim 1, comprising the further steps of:

initially setting a distance between said at least one plasma torch and the melt, which corresponds to an arc length, to a low initial value, and initially adjusting an intensity of electric current to said at least one plasma torch according to a required heating energy:

comparing the required heating energy with a heating energy characteristic value that results from a maximum current intensity and said distance between said at least one plasma torch and the melt; and as long as the required heating energy lies below the heating energy characteristic value, adjusting the target temperature of the melt exclusively via said intensity of electric current and, when the required heating energy is above the heating energy characteristic value, adjusting the target temperature of the melt exclusively via the distance between said at least one plasma torch and the melt.

3. A method of obtaining a variation with time of a target temperature of a molten metal at an outlet of a distributor trough having a system-produced dead time, in which a required heat energy is produced by at least one plasma torch, comprising the steps of:

determining a variation with time of a target temperature of the melt at an entrance into the distributor trough; a total mass of the melt to be introduced into the distributor trough; a mass flow of the melt at an entrance to, and at an exit from, the distributor trough; and a specific heat value of the melt;

ascertaining from the foregoing values a setting signal which corresponds to the required heating energy in order to obtain a desired course of temperature;

simultaneously and continuously measuring an actual temperature of the melt at an outlet of the distributor trough; and when the actual temperature of the melt deviates from the desired course of temperature by an amount in excess of a predeterminable tolerance, changing the setting signal for the required heating energy while compensating for the system-produced dead time, by reducing the setting signal when an actual temperature exceeds the target temperature, and increasing the setting signal when an actual temperature is less than the target temperature.

4. A method according to claim 3, comprising the further steps of:

initially setting a distance between said at least one plasma torch and the melt, which corresponds to an arc length, to a low initial value, and initially adjusting an intensity of electric current to said at least one plasma torch according to a required heating energy:

comparing the required heating energy with a heating energy characteristic value that results from a maximum current intensity and said distance between said at least one plasma torch and the melt; and as long as the required heating energy lies below the heating energy characteristic value, adjusting the target temperature of the melt exclusively via said intensity of electric current and, when the required heating energy is above the heating energy characteristic value, adjusting the target temperature of the melt exclusively via the distance between said at least one plasma torch and the melt.

5. A method of obtaining a variation with time of a target temperature of a molten metal at an outlet of a distributor trough, in which a required heat energy is produced by at least one plasma torch having a predetermined zone of influence, comprising the steps of:

continuously measuring an actual temperature of the melt at an outlet of the distributor trough and the actual temperature of the melt in the predetermined zone of influence of the plasma torch; and when the actual temperature of the melt deviates from a desired course of temperature by more than a predeterminable tolerance, changing a setting signal for the required heating energy by reducing the setting signal when an actual temperature exceeds the target temperature, and increasing the setting signal when an actual temperature is less than the target temperature.

6. A method according to claim 5, comprising the further steps of:

initially setting a distance between said at least one plasma torch and the melt, which corresponds to an arc length, to a low initial value, and initially adjusting an intensity of electric current to said at least one plasma torch according to a required heating energy:

comparing the required heating energy with a heating energy characteristic value that results from a maximum current intensity and said distance between said at least one plasma torch and the melt; and as long as the required heating energy lies below the heating energy characteristic value, adjusting the target temperature of the melt exclusively via said intensity of electric current and, when the required heating energy is above the heating energy characteristic value, adjusting the target temperature of the melt exclusively via the distance between said at least one plasma torch and the melt.

* * * * *